US006352229B1

(12) United States Patent
Adams

(10) Patent No.: US 6,352,229 B1
(45) Date of Patent: Mar. 5, 2002

(54) FLEXIBLE CLIP

(75) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 09/431,844

(22) Filed: Nov. 2, 1999

(51) Int. Cl.[7] ..... B42F 1/02

(52) U.S. Cl. ..... 248/316.7; 248/205.3; 248/206.5; 248/686; 248/683; 248/231.81; 24/67.7; 24/67.11; 24/67 R

(58) Field of Search ..... 248/205.3, 206.5, 248/686, 683, 316.3, 231.81; 24/67.7, 67.11, 67 R

(56) References Cited

U.S. PATENT DOCUMENTS

| | | | | | |
|---|---|---|---|---|---|
| 840,618 | A | * | 1/1907 | Golombek | |
| 979,436 | A | * | 12/1910 | Corbin | |
| 2,505,899 | A | * | 5/1950 | Jobe | 248/206 |
| 3,309,052 | A | * | 3/1967 | Borisof | 248/205 |
| D259,393 | S | * | 6/1981 | Kuru | D8/388 |
| 4,346,501 | A | * | 8/1982 | Saiya | 24/329 |
| 4,536,925 | A | * | 8/1985 | Boothe et al. | 24/511 |
| 4,840,341 | A | * | 6/1989 | Hasegawa | 248/316.5 |
| 5,356,102 | A | | 10/1994 | Blumenaus | 248/205.5 |
| D383,666 | S | | 9/1997 | Adams | D8/395 |
| D396,184 | S | | 7/1998 | Adams et al. | D8/395 |
| D405,681 | S | | 2/1999 | McDowell et al. | D8/367 |
| D416,788 | S | * | 11/1999 | Jones et al. | D8/395 |
| D421,565 | S | * | 3/2000 | Jones et al. | D8/395 |

* cited by examiner

*Primary Examiner*—Leslie A. Braun
*Assistant Examiner*—Steven M. Marsh
(74) *Attorney, Agent, or Firm*—Buchanan Ingersoll, P.C.

(57) ABSTRACT

A spring clip has a base member attached by a flexible connector to a clip member which has a body portion and a flexible tail portion. The base member preferably includes magnets for holding the spring clip against a metal surface. The flexible tail portion has a distal end which is normally biased toward the base member for holding an object therebetween. A gap can be created between the distal end and the base member by pushing on the body portion to cause the clip member to pivot about the flexible connector such that the flexible tail portion moves away from the base member. The gap can also be created by pulling on the distal end which causes the flexible tail to flex away from the base member. Further, the body portion can be pushed to create the gap and the flexible tail portion also flexed to make the gap wider such that thicker objects can be held in the gap. The distal end can be hook shaped to hold a writing instrument or other object. The flexible tail portion can also be made longer so that the distal end extends past the base member and is biased toward a surface on which the base member can be mounted such that the object is held between the distal end and the mounting surface.

28 Claims, 7 Drawing Sheets

FLEXIBLE CLIP

BACKGROUND

1. Field of the Invention.

The invention relates generally to spring clip devices and particularly to spring clip devices having magnets attached thereto for holding the spring clip device against a metal object such as a refrigerator or filing cabinet. More specifically, the invention relates to a spring clip which has more than one flexible member which can be flexed to create a gap between the clip and an opposing surface in which an object can be held.

2. Description of Related Art.

Spring clips are well known in the art, as are devices having magnetic bases for holding the device against a metal surface. Refrigerator magnets are a good example of such devices. For example, in my U.S. Design Pat. No. Des. 383,666, I disclose a spring clip having a clip member and a magnetic base to which the clip member is attached. The clip member has a flexible tail portion and a distal end thereof which is biased against the base member. The tail portion is flexible so that the distal end can be pulled to away from the base member to create a gap in which an object, such as a piece of paper, can be inserted and held. The clip member can be formed into the likeness of an animal. In the case of my aforementioned design patent, the clip member resembles a dog when viewed from the side. However, the clip member can be shaped so as to resemble a variety of different animals, or other recognizable objects.

It is also known in the art to provide spring clips which are attachable to flat surfaces using a suction cup instead of magnets. One such device is disclosed in U.S. Pat. No. 5,356,102 to Blumenaus. In Blumenaus, a flexible plastic clip member is attached to the neck portion of a suction cup member. The flexible clip member has a first end which is normally biased against the surface to which the suction cup member is attached and a second end which can be pushed to create a gap between the first end and the mounting surface. When the second end is pushed, the clip member pivots about the neck portion of the suction cup which creates a gap between the first end of the clip member and the mounting surface.

The two aforementioned types of prior art clip devices are only a representative portion of the numerous types of magnet and suction cup clip devices that are known in the art. However, none of these prior art clip devices employ a flexible clip member which has two separate portions that can flex in order to create the gap between the end of the clip member and the surface against which the object is to be held. Consequently, such devices lack the advantages in both the design and use of a doubly flexible spring clip. Specifically, a spring clip having more than one flexible portion can be used to hold thicker objects and, additionally, provide two alternative ways of creating a gap between the clip member and the opposing surface.

Accordingly, there is a need for a spring clip having more than one separately flexible member to hold wider objects and provide alternative ways of creating a gap in which to insert the object.

SUMMARY

I provide a spring clip having a base member attached by a flexible connector to a clip member which has a body portion and a flexible tail portion. The flexible tail portion has a distal end which is normally biased toward the base member for holding an object therebetween. A gap can be created between the distal end of the flexible tail portion and the base member by pushing on the body portion to cause the clip member to pivot about the flexible connector which causes the flexible tail portion, and thus the distal end, to move away from the base member. An object can be inserted between the distal end and the base member so that when the body portion is released the distal end holds the object against the base member. Additionally, the gap can be created by pulling outwards on the distal end which causes the flexible tail to flex away from the base member so that the object can be placed between the distal end and the base member. Moreover, the body portion can be pushed to create the gap and, at the same time, the flexible tail portion also be flexed in order to make the gap wider such that a thicker object can be held in the gap. Since the width of the gap is shared by the flexible connector and the flexible tail portion, the stresses and strains on either flexible member is reduced so that neither is flexed beyond its memory. The distal end can be provided in the shape of a hook in which a writing instrument can be inserted and held. Alternatively, the hook can be used for hanging an object on. Instead of gripping the object between the distal end and the base member, the flexible tail portion could be made longer, so that the distal end extends past the base member and is biased toward a surface on which the base member can be mounted. In this configuration, the object can be inserted and held between the distal end and the mounting surface.

Other details, objects, and advantages of the invention will become apparent from the following detailed description and the accompanying drawings figures of certain embodiments thereof.

BRIEF DESCRIPTION OF THE DRAWING FIGURES

A more complete understanding of the invention can be obtained by considering the following detailed description in conjunction with the accompanying drawings, in which:

FIG. 1 is a side plane view of a preferred embodiment of the invention;

FIG. 2 a side plan view of an embodiment of the invention showing how the flexible tail portion of the clip member is formed to extend below the surface of the base member such that the distal end is normally biased toward the base member;

Figure 9:
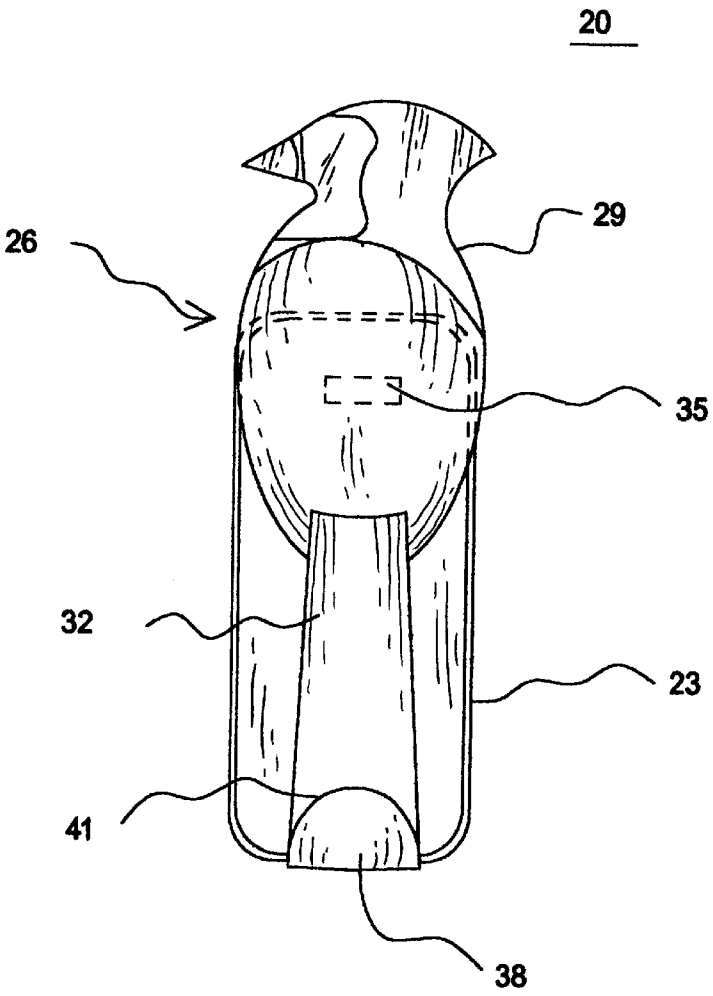
Figure 10:
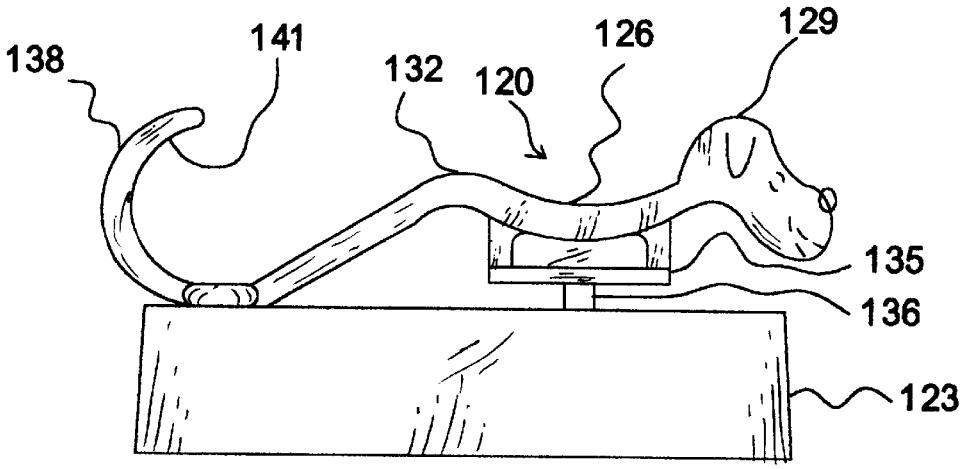
Figure 11:
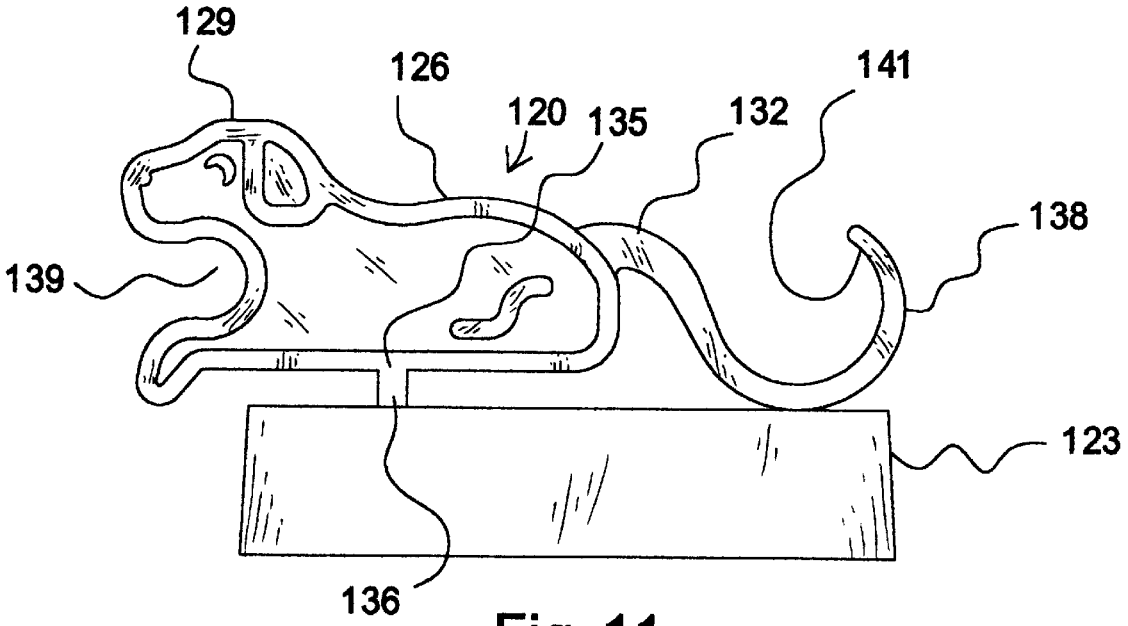
Figure 12:
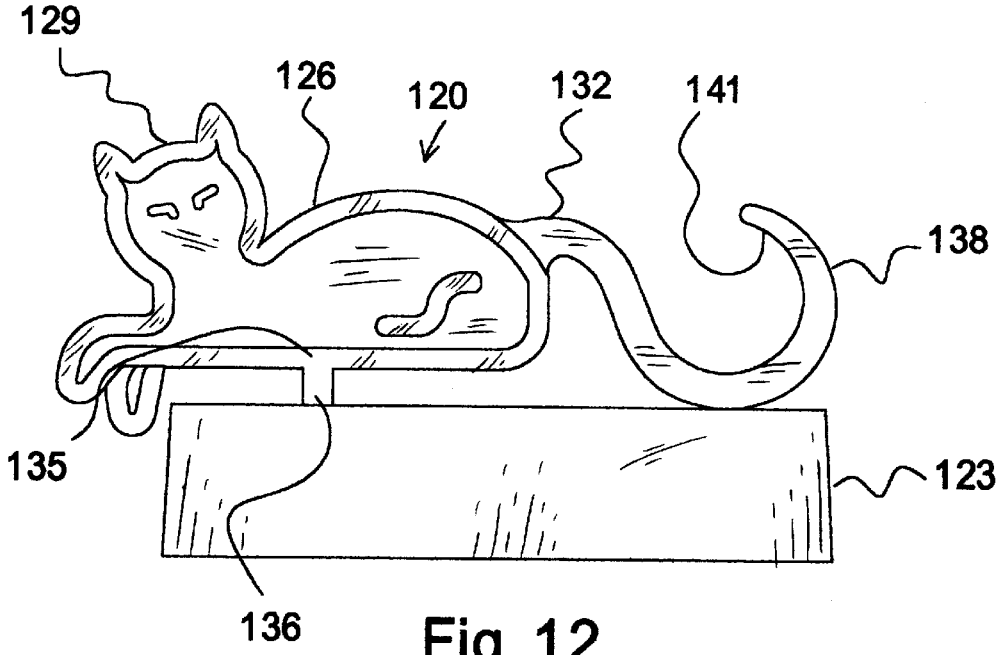
Figure 13:
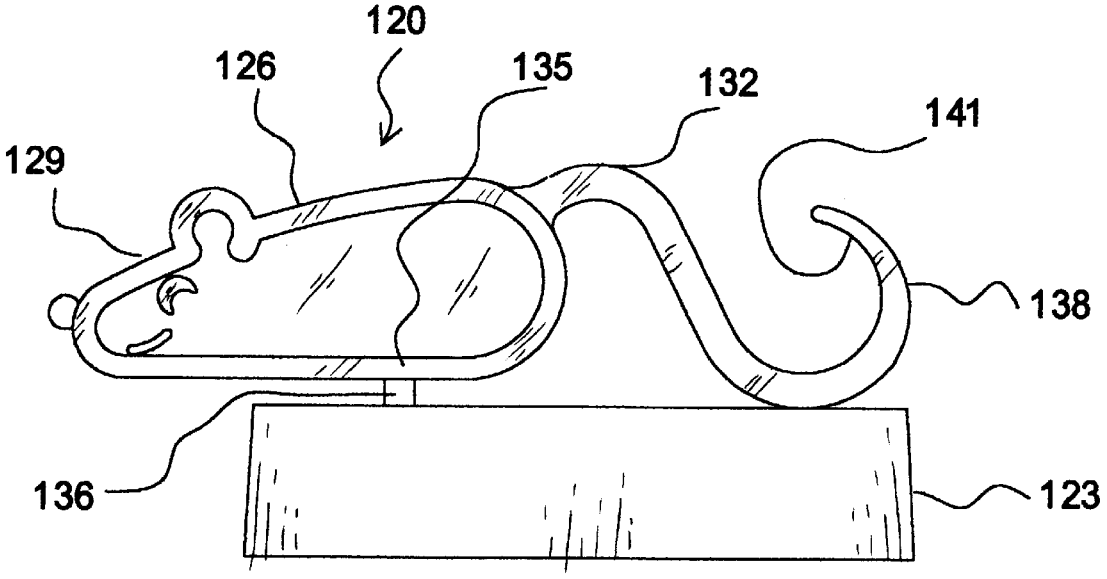

FIG. 9 spring clip configured in the shape of a bird;

FIG. 10. a magnet spring clip similar to that shown in FIG. 9 except shaped in the likeness of the dog;

FIG. 11 is a spring clip as in FIG. 10 also shaped in the likeness of a dog;

FIG. 12 is a magnet spring clip similar to FIG. 11 except shaped in the likeness of a cat; and FIG. 13 is a magnet spring clip similar to that shown in FIG. 12 except shaped in the likeness of mouse.

DETAILED DESCRIPTION OF THE PREFERRED EMBODIMENTS

Figure 2:
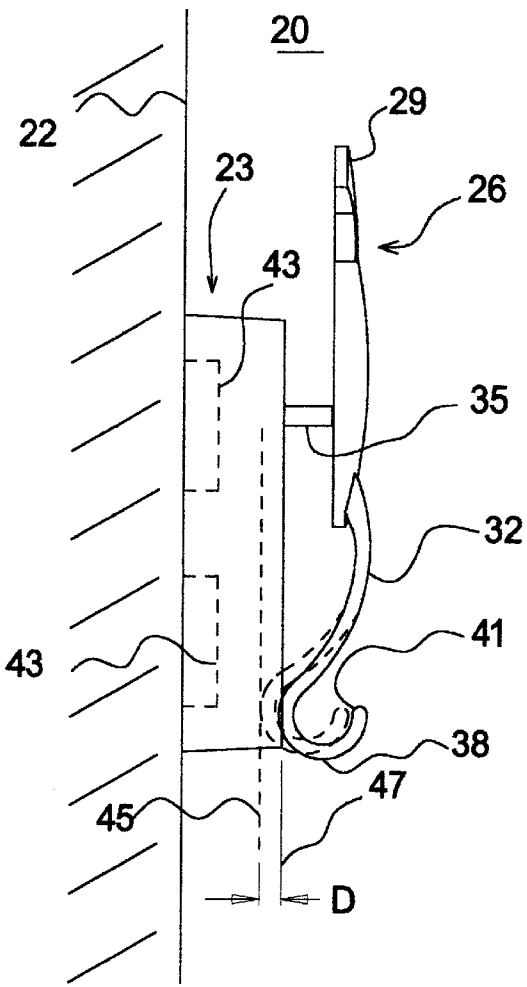
Figure 1:
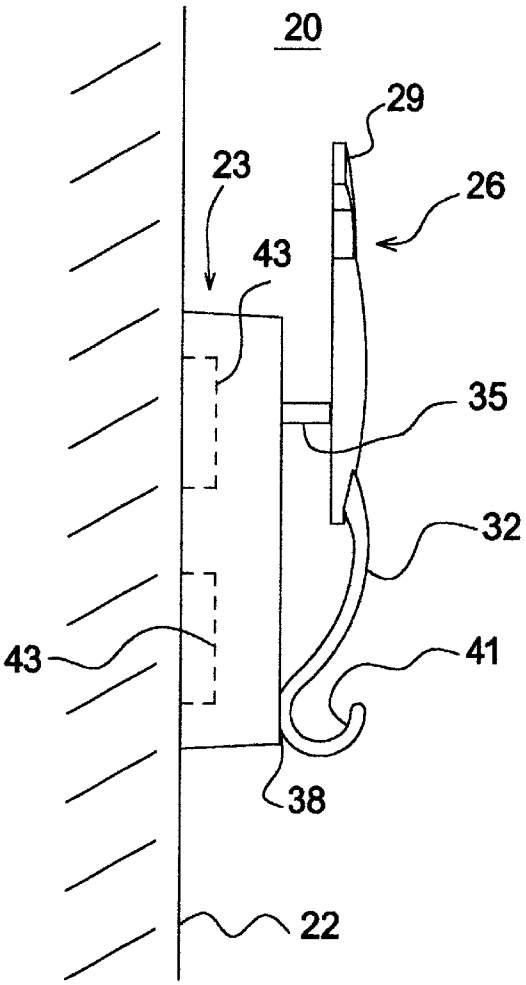

A spring clip 20 is shown in FIG. 1 having a base member 23 and a clip member attached to the base member 23 for holding an object. The clip member 26 has a body portion 29 and a flexible tail portion 32. A flexible connector 35 attaches the clip member 26 to the base member 23. The flexible tail portion 32 has a distal end 38 which is normally biased toward the base member 23. The flexible tail portion 32 is formed such that, were the distal portion 38 not biased against the base member 23, for example, it would extend a certain distance "D" below the surface of the base member 23. The position which the distal end 38 would occupy if free to do so is shown in broken lines in FIG. 2. The distance between an imaginary line 45 and the surface of the base member 23, labeled line 47, illustrates the distance which the flexible tail portion 32 is compressed when the clip member 26 is attached to the base member 23. Preferably, the distal end 38 of the flexible tail portion 32 is provided in the shape of a hook 41 such that a writing instrument could be inserted into the hook 41 and held thereby. Additionally the hook 41 could be used to hang objects therefrom. As shown in the drawing figures, the base member 23 preferably has a pair of magnets 43, which could also be a single magnet, attached to the underside thereof in order to hold the base member 23 and the clip member 26 to a metal surface 22, such as on a refrigerator or filing cabinet. One could use an adhesive or double sided tape or suction cups in place of the magnets 43. Another alternative is to more permanently attach the base 23 to the surface 22 using nails or screws.

Figure 3:
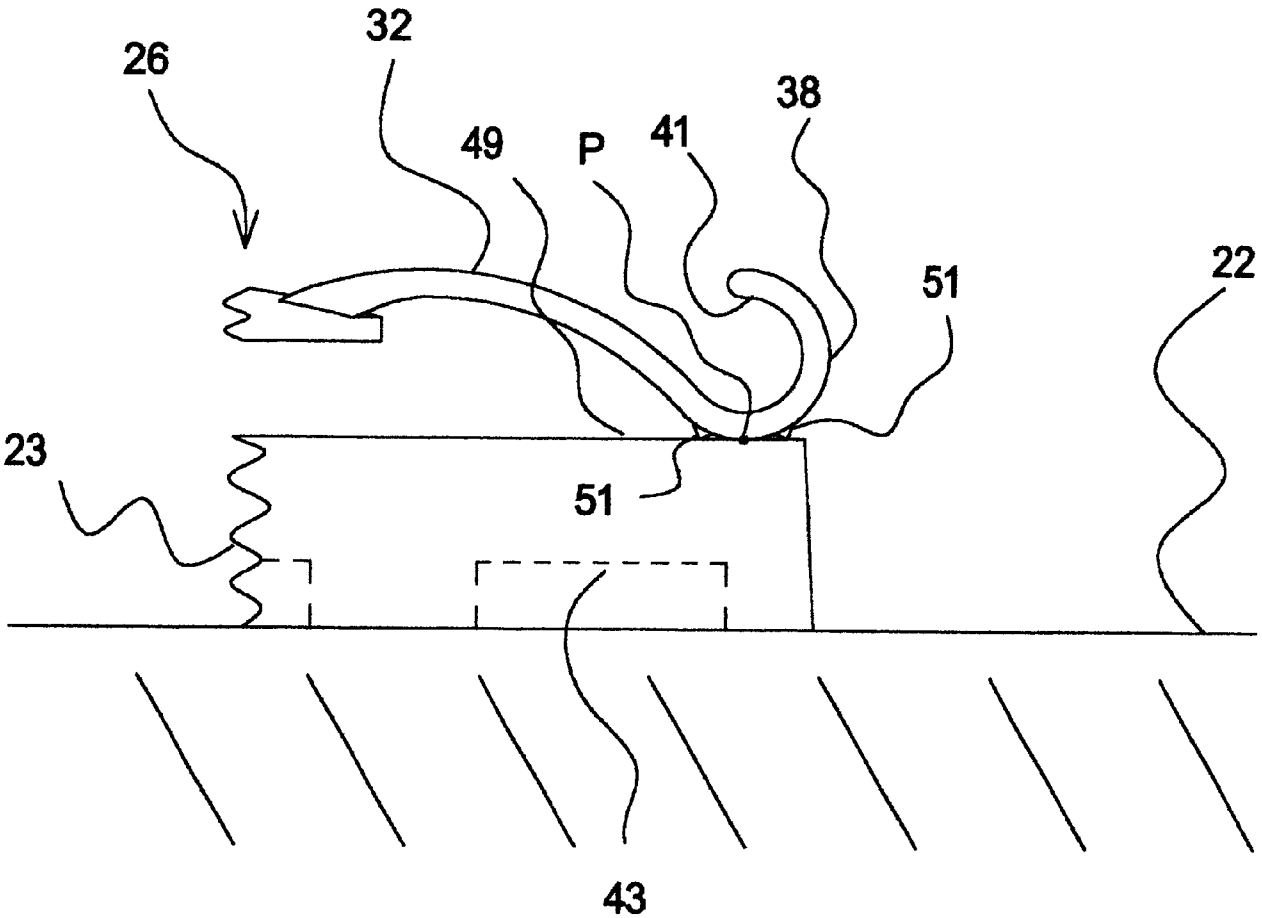
FIG. 3 is a side plan of one preferred configuration for the distal end of the tail portion of the clip member.
Figure 5:
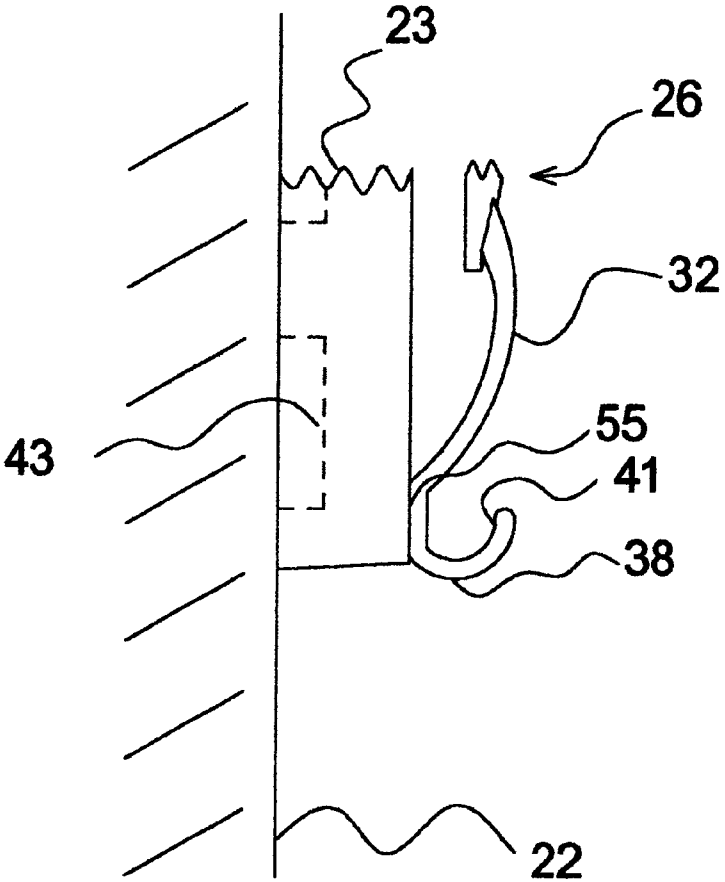
FIG. 5 is a further preferred configuration for the distal end of the tail portion of the clip member.
Figure 4:
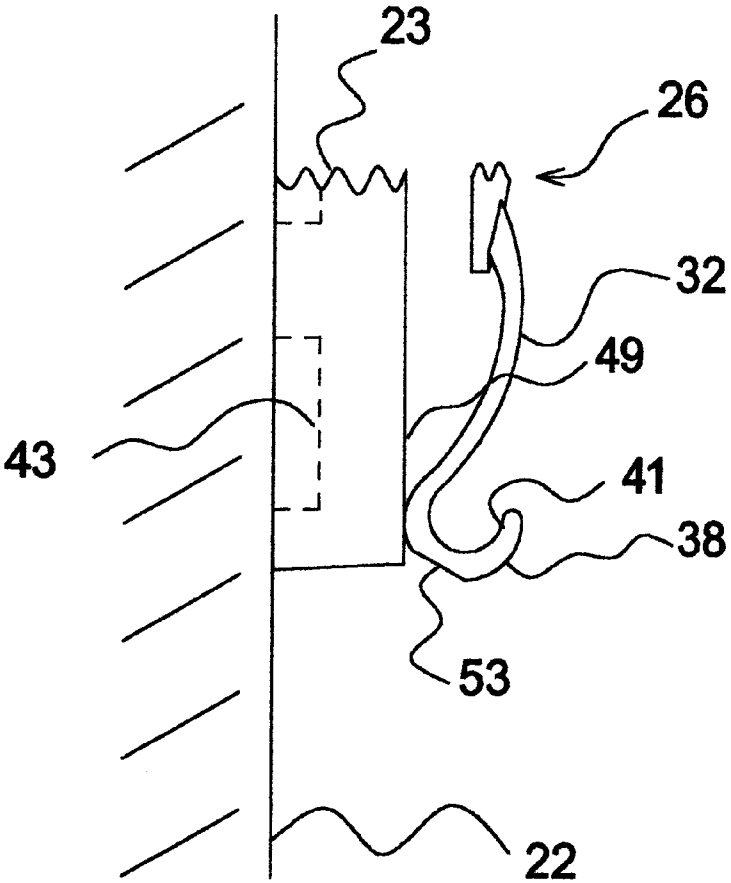
FIG. 4 is a side plan view portion in section of another preferred configuration for the distal end of the tail portion of the clip member.

The flexible tail portion 32, and particularly the lower, gripping surface 49 of the distal end 38 can be provided in various configurations as illustrated in FIGS. 3–5. For example, in FIG. 3 a pair of spikes 51 are provided on the gripping surface of the distal portion 38. In this embodiment, the gripping surface 49 is a generally arcuate curved surface, thus the contact between the gripping surface 49 and the base member 23 occurs at a single point "P" along the radius of the curvature. The spikes 51 are preferably provided on opposite sides of this point and are sized to project from the gripping surface 49 into contact with the base member 23. I prefer that the spikes 51 not be so long as to cause the gripping surface 49 to lose contact with the base member 23 by providing additional points of contact or penetrating into the object being held. The spikes 51 are designed to better grip an object which is being held between the distal end 38 and the base member 23. In order to facilitate the insertion of an object between the gripping surface 49 of the distal end 38 and the mounting surface 22, the end of the distal portion 38 can have a sloping surface 53 which slopes away from the gripping surface 49 where the distal end 38 contacts the base member 23, as shown in FIG. 4. In FIG. 5 another embodiment of the flexible tail portion is shown wherein the distal end 38 has a generally flat gripping surface 55 for holding the object against the base member 23. If desired, it would be possible to provide the gripping surface 55 with grooves or a plurality of spikes, or to angle the end of the distal end 38 where it meets the base member for the purposes described previously, e.g. better gripping an object held between, or facilitating the insertion of the object between the gripping surface 55 and the base member 23.

Figure 6:
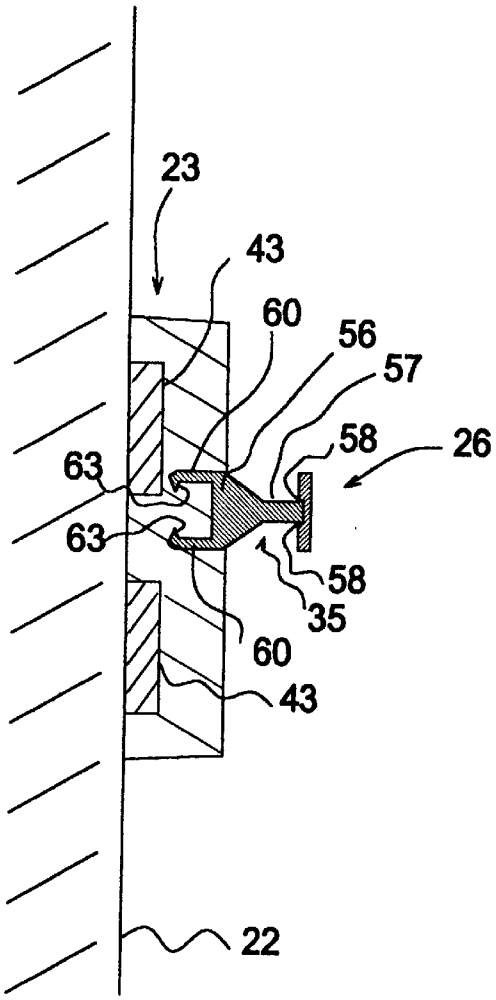
FIG. 6 is a cross sectional view of the spring clip showing a preferred configuration of the flexible connector which joins the clip portion to the base member.

The resiliently flexible connector 35 which attaches the clip member 26 to the base member 23 can be configured as shown in FIG. 6. The flexible connector 35 has a base portion 56 which connects into the base member 23 and a post portion 57 which attaches to the body portion 29 of the clip member 26. The post portion 57 preferably has a radius 58 on either side of the post portion 57 at the attachment point to the body portion 29. The radiused portions 58 reduce the stresses on the post portion 57 when the clip member 26 is pivoted about the base member 23. The base portion 56 of the flexible connector 35 has a pair of projecting arms 60 which snap into slots provided in the base member 23. Each of the arms 60 has a tip portion 63 which project towards the opposing arm 60 to aid in locking the base 56 of the flexible connector 35 to the base member 23. The flexible connector 35 can be attached to the base member 23 at various locations along the length thereof. If the flexible connector 35 is used to attach the clip member 26 to an upper portion of the base member 23, pushing on the body portion 29 of the clip member 26 creates a torque about the flexible connector 35. This torque tends to lift the lower portion of the base member 23, which can result in the base member 23 becoming detached from the mounting surface 22. Mounting the flexible connector 35 to the base member 23 near the lower portion of the base member 23 can result in less torque when the clip member 26 is pivoted about the flexible connector 35 such that there is less of a tendency for the base member 23 to become detached from the mounting surface 22. However, in the embodiment of the clip member 26 illustrated in FIGS. 1–5, the flexible connector 35 cannot be positioned too close to the edge of the base member 23 because the distal end 38 of the flexible tail portion 32 must be biased toward the base member 23 to hold the object therebetween. Therefore, in that embodiment, the flexible connector 35 must be attached to the base member 23 near the upper edge thereof.

Figure 7:
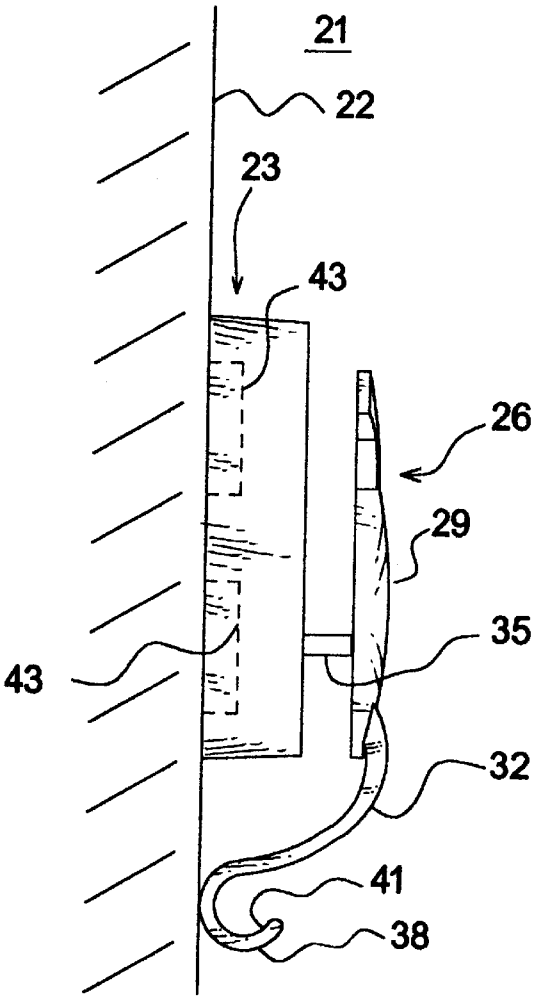
FIG. 7 shows an alternative embodiment of the spring clip wherein the tail portion extends beyond the base member so that the distal end is biased toward a surface on which the base member is mounted.

An alternatively configured spring clip 21 which takes advantage of the benefits of mounting the flexible connector 35 closer to the lower edge of the base member 23 is shown in FIG. 7. In this embodiment, the flexible tail portion 32 extends beyond the lower edge of the base member 23 and the distal end 41 is biased toward the mounting surface 22 on which the base member 23 is mounted. This clip member 26 functions in the same manner as in the previous embodiments with the exception being that the distal end 38 holds the object against the mounting surface 22 rather than against the base member 23.

In each of the described embodiments of the spring clip 20, 21 a gap may be created between the distal end 38 and the base member 23, or the mounting surface 22, so that an object can be inserted an held between the distal end 38 and the base member 23. The first manner of creating the gap between the distal end 38 and the base member 23, or mounting surface 22, is to push on the body portion 29 of the spring clip 26 to cause the spring clip 26 to pivot about the flexible connector 35. This lifts the flexible tail portion 32, thus moving the distal end 38 away from the base member 23, or the mounting surface 22, to permit an object to be inserted therebetween. Once the object is inserted between the distal end 38 and the base member 23, the pressure may be removed from the body portion 29 to allow the clip member 26 to return to its original position biased toward the base member 23.

A second way to create a gap between the distal end 38 and a base member 23, or a mounting surface 22, is by pulling outwards on the distal end 38 which causes the flexible tail portion 32 to flex away from the base member 23 so that an object can be inserted therebetween. The distal end 38 can be released to hold the object against the base member 23. Additionally, not only can the gap be created in separate ways, the two ways are complementary. For example, pushing on the body portion 29 causes the clip member 26 to pivot about the flexible connector 35 to open a gap between the distal end 38 and the base member so that an object can be inserted therebetween. Subsequently, if a wider gap is needed to permit the insertion of a thicker object, the distal end 38 of the flexible tail portion 32 can also be pulled outward while the body portion 29 still has the clip member 26 pivoted about the flexible connector 35. Consequently, the flexible connector 35 and flexible tail portion 32 provide the dual benefits of (1) optional methods for opening the gap and (2) making it possible to create a wider gap to hold thicker objects. A further advantage of the two complementary flexible members 32, 35 is that thicker objects can be held without stressing or straining either the flexible connector or the flexible tail spring past its elastic limit.

The flexible connector 35 is designed to have a certain thickness depending on the length of the flexible connector such that when the body portion 29 is pivoted as far forward as it will go, thereby bending the flexible member 35 at the greatest amount, the maximum bending stress is less than that which would strain or weaken the flexible connector 35. If the flexible connector 35 were to be made longer, other things being equal, this would generally permit a wider gap to be opened between the distal end and the base member 23. However., it could also result in greater bending stresses in the flexible connector 35 such that it may deform or break. However, by using a shorter flexible connector 35, the clip member 26 must be positioned closer to the base member 23, which has the effect of limiting the size of the gap that can be opened between the distal end 38 of the base member 23. Yet, this can be helped by the provision of the second flexible member, i.e. the flexible tail portion 32, which makes it possible to open a wider gap between the distal end 38 and the base member 23 by providing another flexible member, in addition to the flexible connector 35, which provides for a wider gap between the distal end 38 and the base member 23 in spite of the shorter flexible connector 35. Thus, a further benefit of two flexible members 32, 35 is that the clip member 26 may be attached closer to the base member 23 to provide a thinner profile without sacrificing the ability to create a wider gap to hold thicker objects.

Figure 8:
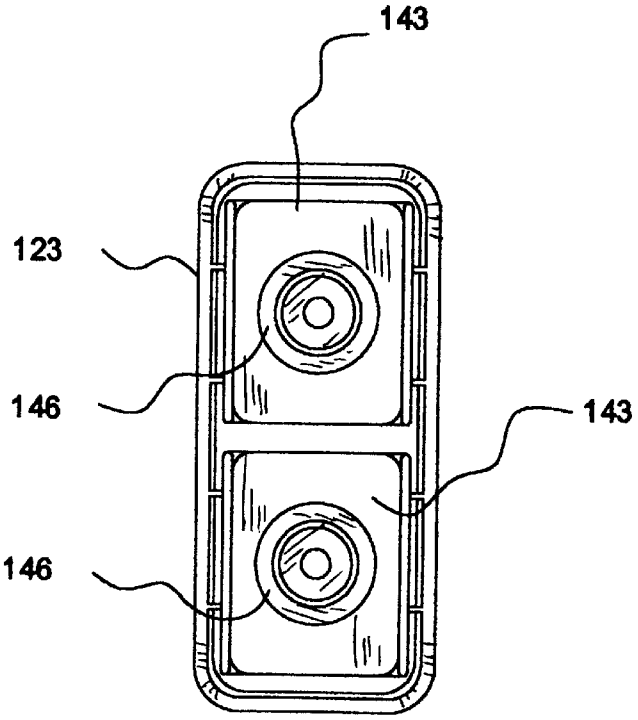
FIG. 8 is a bottom plan view of a present preferred base member having a magnet for attaching the base member to a metal surface.

The base member 23 of the spring clip device 20, or 21, is shown in FIG. 8 having a pair of magnets 43 connected to the base member 23 so that the spring clip 20, 21 can be mounted on a metal surface. Such magnets could be connected to the base member 23 using rivets 44 used to connect the magnets 43 to the base member 23 in FIG. 8.

The clip member 26 is preferably formed in the likeness of an animal. For example, the clip member 26 can be shaped in the likeness of a bird as shown in FIG. 9. FIGS. 10–13 illustrate additional variations in of animals in which the shape of the clip member 26 could be formed. In these examples, the spring clip magnets 120 have a clip member 126 attached to a magnetic base member 123 by a connecting member 135 having a flexible post 136. The clip member 126 similarly has a body portion 129, a flexible tail portion 132 and a distal end 138 with a hook 141. The flexible tail portion 132 can be flexed to create a gap between the distal portion 138 and the base member 123. The post 36 of the connecting member 135 may also flex to lift the distal portion 183 of the tail from the base member 143. The clip member 126 is shown in various configurations in the likeness of different animals in FIGS. 10–13. For example, a dog is shown in FIGS. 10 and 11; a cat in FIG. 12; and a mouse in FIG. 13. The dog in FIG. 11 is shaped to hold a pencil between his head and front legs in space 139.

Although certain embodiments of the invention have been described in detail, it will be appreciated by those skilled in the art that various modifications to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A spring clip comprising:

a. a base member;

b. a clip member having a body portion and a flexible tail portion, said flexible tail portion having a distal end normally biased toward and in contact with said base member such that a gap can be created between said distal end of said flexible tail portion and said base member by a first step of pulling on said distal end to flex said flexible tail in relation to said body portion; and c. a flexible connector attaching said body portion to said base member in a manner so that a gap can be created between said distal end and said base member by a second step of pushing on said body portion to cause said to pivot together about said body and flexible tail portions of said clip member flexible connector.

2. The spring clip of claim 1 further comprising said distal end extending beyond said base member and being normally biased toward a mounting surface when said base member is mounted on said mounting surface.

3. The spring clip of claim 1 wherein said flexible tail is generally C-shaped having a convex portion extending toward said base member and transitioning into a concavely curved portion at said distal end biased toward said base member.

4. The spring clip of claim 1 further comprising said distal end being hook shaped.

5. The spring clip of claim 4 wherein said hook shape is shaped to hold a writing implement.

6. The spring clip of claim 1 further comprising a gripping surface on said distal end which is normally biased toward said base member, said gripping surface having an arcuate shape.

7. The spring clip of claim 6 further comprising at least one spike provided on said arcuate gripping surface, said at least one spike disposed on one side of an axis through a point on the radius of said arcuate gripping surface where said arcuate gripping surface contacts said base member to hold an object therebetween.

8. The spring clip of claim 7 wherein said at least one spike comprises a pair of spikes, each of said pair of spikes disposed on said arcuate gripping surface on an opposite side of said axis.

9. The spring clip of claim 1 further comprising a gripping surface on said distal end which is normally biased toward said base member, said gripping surface being generally flat.

10. The spring clip of claim 1 further comprising said distal end having an angled lower surface sloping away from said base member from a point where said distal end contacts said base member, said sloping surface positioned to facilitate the insertion of an object between said distal end and said base member.

11. The spring clip of claim 1 wherein said flexible connector comprises:

a. a resiliently flexible post member having a base end connected to said base member and an opposite clip end attached to said body member;

b. said post member having a length defining a distance which said body portion is spaced apart from said base member;

c. said length sized such that for a degree of bending imposed on said post member by pushing on said body portion to pivot said clip member about said flexible connector is limited by said body portion coming into contact with said base member; and d. wherein said degree of bending is thus restricted to an amount which results in a range of bending stresses which said post member can endure repeatedly and still maintain resiliency.

12. The spring clip of claim 11 further comprising:

a. a resiliently flexible post member having a base end connected to said base member and an opposite clip end attached to said body member; and b. said clip end being radiused on opposite sides thereof where said clip end attaches to said body member.

13. The spring clip of claim 1 further comprising a magnetic member connected to an underside of said base member for mounting said base member on a magnetically attractive surface.

14. The spring clip of claim 1 wherein said clip member is formed in the likeness of an animal.

15. The spring clip of claim 14 wherein said animal likeness chosen from the group consisting of a dog, cat, bird, or mouse.

16. A spring clip comprising:

a. a base member;

b. a clip member having a body portion and a flexible tail portion, said flexible tail portion having a distal end extending beyond said base member and normally biased toward a mounting surface when said base member is mounted on said mounting surface such that a gap can be created between said flexible tail portion and said mounting surface by pulling on said distal end to flex said flexible tail; and c. a flexible connector attaching said body portion to said base member in a manner so that a gap can be created between said distal end and said mounting surface by pushing on said body portion to cause said clip member to pivot about said flexible connector.

17. The spring clip of claim 16 wherein said flexible tail is generally C-shaped having a convex portion extending toward said base member and transitioning into a concavely curved portion at said distal end where biased toward said mounting surface.

18. The spring clip of claim 16 further comprising said distal end being hook shaped.

19. The spring clip of claim 16 wherein said hook shaped is shaped to hold a writing implement.

20. The spring clip of claim 16 further comprising a gripping surface on said distal end which is normally biased toward said mounting surface, said gripping surface having an arcuate shape.

21. The spring clip of claim 20 further comprising at least one spike provided on said arcuate gripping surface, said at least one spike disposed on one side of an axis through a point on the radius of said arcuate gripping surface where said arcuate gripping surface contacts said mounting surface to hold an object therebetween.

22. The spring clip of claim 21 wherein said at least one spike comprises a pair of spikes, each of said pair of spikes disposed on said arcuate gripping surface on an opposite side of said axis.

23. The spring clip of claim 16 further comprising a gripping surface on said distal end which is normally biased toward said mounting surface, said gripping surface being generally flat.

24. The spring clip of claim 16 further comprising said distal end having an angled lower surface sloping away from said mounting surface from a point where said distal end contacts said mounting surface, said sloping surface positioned to facilitate the insertion of an object between said distal end and said mounting surface.

25. The spring clip of claim 16 wherein said flexible connector comprises:

a. a resiliently flexible post member having a base end connected to said base member and an opposite clip end attached to said body member; and b. said post member having a length defining a distance which said body portion is space apart from said base member;

c. said length sized such that for a degree of bending imposed on said post member by pushing on said body portion to pivot said clip member about said flexible connector is limited by said body portion coming into contact with said base member; and d. wherein said degree of bending is thus restricted to an amount which results in a range of bending stresses which said post member can endure repeatedly and still maintain resiliency.

26. The spring clip of claim 25 further comprising:

a. a resiliently flexible post member having a base end connected to said base member and an opposite clip end attached to said body member; and b. said clip end being radiused on opposite sides thereof where said clip end attaches to said body member.

27. The spring clip of claim 16 wherein said clip member is formed in the likeness of an animal.

28. The spring clip of claim 27 wherein said animal is chosen from the group consisting of a dog, cat, mouse and bird.

* * * * *

UNITED STATES PATENT AND TRADEMARK OFFICE

CERTIFICATE OF CORRECTION

PATENT NO. : 6,352,229 B1
DATED : March 5, 2002
INVENTOR(S) : William E. Adams

It is certified that error appears in the above-identified patent and that said Letters Patent is hereby corrected as shown below:

Column 6,
Line 31, before the first occurrence of "said", insert -- said body and flexible tail portions of --.
Line 31, after the first occurrence of "said", insert -- clip member --.
Line 32, after "member", insert -- to pivot together about said --.

Column 7,
Line 41, after "said", insert -- distal end of said --.
Line 42, after "by", insert -- a first step of --.
Line 43, after "tail", insert -- in relation to said body portion --.
Line 46, before "pushing", insert -- a second step of --.
Line 47, after "pivot", insert -- together --.

Signed and Sealed this

Sixteenth Day of December, 2003

JAMES E. ROGAN
*Director of the United States Patent and Trademark Office*